US006545652B1

(12) United States Patent
Tsuji

(10) Patent No.: US 6,545,652 B1
(45) Date of Patent: Apr. 8, 2003

(54) IMAGE DISPLAY APPARATUS AND ITS METHOD OF OPERATION

(75) Inventor: Ryuhei Tsuji, Anan (JP)

(73) Assignee: Nichia Corporation, Tokushima (JP)

( * ) Notice: Subject to any disclaimer, the term of this patent is extended or adjusted under 35 U.S.C. 154(b) by 117 days.

(21) Appl. No.: 09/610,991

(22) Filed: Jul. 6, 2000

(30) Foreign Application Priority Data

Jul. 8, 1999 (JP) ..... 11-194551
Oct. 25, 1999 (JP) ..... 11-302493
Oct. 25, 1999 (JP) ..... 11-303134

(51) Int. Cl.[7] ..... G09G 3/32

(52) U.S. Cl. ..... 345/82; 345/76; 345/77; 345/78; 345/204; 345/214; 345/350; 315/169.1; 315/169.2; 315/169.3

(58) Field of Search ..... 345/82, 350, 76, 345/77, 78, 204, 214; 315/169.3, 169.1, 169.2

(56) References Cited

U.S. PATENT DOCUMENTS

| | | | | |
|---|---|---|---|---|
| 3,696,393 | A | 10/1972 | McDonald | |
| 4,755,807 | A | 7/1988 | Guennou | |
| 4,825,201 | A | 4/1989 | Watanabe et al. | |
| 5,719,589 | A | 2/1998 | Norman et al. | |
| 5,748,160 | A | 5/1998 | Shieh et al. | |
| 5,844,368 | A * | 12/1998 | Okuda et al. | 315/169.3 |
| 5,923,309 | A | 7/1999 | Ishizuka et al. | |
| 6,339,415 | B2 * | 1/2002 | Ishizuka | 345/76 |
| 6,351,255 | B1 * | 2/2002 | Ishizuka et al. | 345/77 |
| 6,369,515 | B1 * | 4/2002 | Okuda | 315/169.3 |
| 6,369,516 | B1 * | 4/2002 | Iketsu et al. | 315/169.3 |

FOREIGN PATENT DOCUMENTS

| | | |
|---|---|---|
| DE | 32 22 973 A1 | 12/1983 |
| DE | 34 00 056 A1 | 7/1985 |
| EP | 0 464 418 | 1/1992 |
| EP | 0 702 347 A1 | 3/1996 |
| EP | 0 784 305 | 7/1997 |
| EP | 09305146 | 11/1997 |
| JP | 4-98089 | 8/1992 |
| JP | 4-257464 | 9/1992 |
| JP | 5-265419 | 10/1993 |
| JP | 5-273939 | 10/1993 |
| JP | 6-67622 | 3/1994 |
| JP | 6-337402 | 12/1994 |
| JP | 7-199861 | 8/1995 |
| JP | 9-244596 | 9/1997 |
| JP | 9-258693 | 10/1997 |
| JP | 10-112391 | 4/1998 |
| JP | 10-341358 | 12/1998 |
| JP | 11-095723 | 4/1999 |
| JP | 11-161219 | 6/1999 |
| JP | 2000-221935 | 8/2000 |

OTHER PUBLICATIONS

Australian Patent Office Written Opinion; Sep. 17, 2002; Application No. SG 200003689–9.

* cited by examiner

*Primary Examiner*—Richard Hjerpe
*Assistant Examiner*—Jennifer T. Nguyen
(74) *Attorney, Agent, or Firm*—Wenderoth, Lind & Ponack, L.L.P.

(57) ABSTRACT

The image display apparatus is provided with a dot matrix of light emitting devices, driver circuitry, and switching circuitry. The dot matrix is a plurality of light emitting devices arranged in an m-line by n-column matrix, and one terminal of each light emitting device in each line is connected to a common source line. Driver circuitry controls light emitting devices active or inactive depending on an input illumination signal. In the active state, switching circuitry floats common source lines, and in the inactive state, discharges all common source lines to ground.

20 Claims, 12 Drawing Sheets

IMAGE DISPLAY APPARATUS AND ITS METHOD OF OPERATION

This application is based on applications No. 11-194551 filed in Japan on Jul. 8, 1999, No. 11-302493 filed in Japan on Oct. 25, 1999, and No. 11-303134 in Japan on Oct. 25, 1999, the contents of which incorporated hereinto by references.

BACKGROUND OF THE INVENTION

The present invention relates to a display apparatus provided with a plurality of light emitting devices such as light emitting diodes arrayed in a matrix A display panel, and to its method of operation.

Currently, bright red, green, and blue (RGB) light emitting diodes (LEDs) of 1000 mcd or more have been developed, and fabrication of large-scale LED displays has become possible. These LED displays have features such as low power consumption, lightness in weight, and the possibility for thin panel display. Further, demand for large-scale displays, which can be used out doors, has increased dramatically.

Practical large-scale LED displays are configured to fit the installation space by assembling a plurality of LED units. An LED unit is formed from a dot matrix array of RGB LEDs arranged on a substrate board.

Further, an LED display is provided with a driver circuit capable of driving each individual light emitting diode. Specifically, each LED control device, which transmits display data to each LED unit, is connected to the LED display, and a plurality of LED units are connected to form one large-scale LED display. The number of LED units used increases as the LED display becomes larger in scale. For example, a large-scale display can use 300 vertical×400 horizontal, or 120,000 LED units.

The LED display uses a dynamic driver system as its driver method, and specifically, the display is connected and driven as described below.

For example, in an m×n dot matrix LED unit, each LED anode in each line is connected to a common source line, and each LED cathode in each column is connected to a common current line. The m-line common source lines are sequentially turned on for display with a prescribed period. For example, m-line common source line switching is performed via decoder circuitry based on the address signal.

However, when LEDs connected to a selected common source line were activated in related art apparatus, charge accumulated in non-activated LEDs connected to unselected common source lines. When these common source lines were then selected, excess current developed as a result of charge built-up during their inactive period. As a result of this problem, LEDs controlled to be off emitted low levels of light and sufficient image contrast could not be obtained. These types of effects caused display quality degradation.

Thus, the first object of the present invention is to reduce the effects of accumulated charge and provide a high quality image display apparatus and its method of operation.

Further, in an LED display, corrected image data are typically used for each LED device to display a high quality image. This is because device-to-device LED variation in brightness, for example, is relatively large.

More specifically, the control circuit has a read-only-memory (ROM) correction data memory section to store correction data corresponding to each LED device. Corrected image data based on the correction data stored in ROM has been used for display.

However, since correction data were stored in ROM in related art apparatus, correction data could not be re-written. Consequently, related art apparatus had the problem that it was necessary to provide a re-writable memory device separate from ROM when different correction data were required.

Thus, the second object of the present invention is to provide an image display apparatus which can store a plurality of correction data in one correction data memory section.

Further, to accurately represent image data on an LED display, the light emission characteristics (driving current vs. brightness characteristics) of each LED device in the image display apparatus must be uniform. However, since LEDs are fabricated on wafers by semiconductor technology, light emission characteristic variation results from fabrication lot-to-lot, wafer-to-wafer, and chip-to-chip. Therefore, it is necessary to correct image data amplitude to compensate for light emission characteristic differences of the LED for each pixel.

An example of related art image data correction is described as follows.

Turning to FIG. 12, a block diagram of an embodiment of a related art LED display is shown. In FIG. 12, 101 is an m-line n-column LED matrix, 107 is a control circuit, 105 is a microprocessor unit (MPU), 106 is a ROM to store correction data, 102 is a common driver circuit, 103 are horizontal driver circuits, 109 are correction circuits to correct image data, and 110 are random access memory (RAM) to temporarily store correction data. The horizontal driver circuits 103, correction circuits 109, and RAM 110 are integrated in LED driver integrated circuits (IC's) 104 (k) provided for each column of the LED matrix (k=1 to n).

First, prior to display illumination, correction data for the m×n pixels stored in ROM are transferred to a high speed buffers. RAM 110 are used as the high speed buffers. Correction data transfer is accomplished as follows. First, correction data held in ROM 106 are read out by the MPU 105. The MPU 105 sequentially selects LED driver IC's 104 (k) via the address bus 111 and sequentially outputs one columns-worth, or m-pixels, of correction data corresponding to each selected column. The correction data output is input to each LED driver IC 104 (k) via the correction data bus 112 and stored in RAM 110 internal to the LED driver IC 104 (k).

When LEDs are illuminated, correction data stored in RAM 110 are sequentially read out by correction circuits 109. The value of input image data (IMDATA) is increased or decreased for each pixel based on the correction data to achieve image data correction. Corrected image data are output to the driver circuits 103, and the driver circuits 103 produce driving current for each LED based on the corrected image data.

However, in the related art LED display described above, a total of m×n pixels-worth of correction data must be stored in the buffers, or RAM 110, and as display pixel count increases, very large RAM capacity becomes necessary. Further, the operation of correction data read-out from RAM 110 to the correction circuits 109 becomes complicated as the amount of RAM increases. In addition to these problems, both the address bus 111 and the data bus 112 must branch to, and connect with, each of the n driver IC's 104 (1 to n), thereby making wiring complex and peripheral circuitry large in area.

Thus, the third object of the present invention reflects consideration of these problems, and is to provide an image display The above and further objects and features of the invention will more fully be apparent from the following detailed description with accompanying drawings.

SUMMARY OF THE INVENTION

The image display apparatus of the present invention is provided with a dot matrix of light emitting devices, driver circuitry, and a switching circuit section. The dot matrix is a plurality of light emitting devices arranged in a matrix of m-lines and n-columns. One terminal of each light emitting device in each column is connected to a current line, and the other terminal of each light emitting device in each line is connected to a common source line. Driver circuitry controls the display drive to be in an active or inactive state depending on an input illumination signal. In the display drive active state, driver circuitry controls connection of one end of each common source line and each current line according to input display data. The switching circuit section floats the other end of each common source line in the active state and connects the other end of all common source lines to ground in the inactive state.

In this image display apparatus, charge accumulated at light emitting devices and their periphery in the active state, is discharged via the switching circuit section during the inactive state. Consequently, the effects of charge accumulated during active illumination of prescribed light emitting devices are essentially eliminated, and a high quality image display apparatus is realized.

In the image display apparatus of the present invention, driver circuitry can be configured as m-units of current source switching circuits connected to respective common source lines, and a constant current control circuit section. In the active state, a current source switching circuit connects a current source to the common source line selected by an input address signal. The constant current control circuit section is provided with memory circuits, and these memory circuits store pixel level data for n-pixels of sequentially input display data. In the active state, the constant current control circuit section drives a current line for the pixel level width corresponding to pixel level data stored in the memory circuit.

Further, the present invention is a method of operation of an image display apparatus provided with a plurality of light emitting devices arranged in a dot matrix of m-lines and n-columns, wherein one terminal of each light emitting device in each column is connected to a current line, and the other terminal of each light emitting device in each line is connected to a common source line. This method of operation is characterized by inclusion of a step to control active and inactive states according to an illumination control signal which controls the state of illumination, a step to control conduction through one end of each common source line and one end of each current line in the active state based on input display data, and a step to float the other end of each common source line in the active state and ground the other end of each common source line in the inactive state.

In the image display apparatus and method of operation of the present invention, charge accumulated at light emitting devices and their periphery in the active state can be discharged via the switching circuit section during the inactive state. Consequently, the effects of charge accumulated during active illumination of prescribed light emitting devices can essentially be eliminated, and a high quality image display apparatus and method of operation can be offered.

Further, the image display apparatus of the present invention is provided with a display section of light emitting devices arrayed in an m-line by n-column matrix, a correction data memory section to store correction data corresponding to each respective light emitting device, and control and driver circuitry to correct input image data based on the correction data and to display an image on the display section using the corrected image data. The correction data memory section is provided with a single memory unit having a read-only first memory bank, which holds prestored first correction data, and a writable second memory bank.

An image display apparatus of this structure can retain first correction data in the first memory bank without erasure, and can use the writable second memory bank to store second correction data, which are different than the first correction data. Depending on requirements, either the first correction data or the second correction data can be selected to revise the image data. In the image display apparatus of the present invention, the correction data memory section can be configured using non-volatile memory which is electrically erasable and writable.

The image display apparatus of the present invention may also be provided with a communication control section. The communication control section can allow writing of second correction data, which are different than first correction data, to the second memory bank, and forbid writing to the first memory bank. It is also desirable to be able to set the writable second memory bank to forbid writing and protect correction data written into that memory bank.

In the correction data memory section of the image display apparatus of the present invention, it is desirable to store correction data for each pixel such that the address corresponds to the light emitting device for each pixel, and the first memory bank and the second memory bank can be distinguished by the highest order address bit. In this manner, lower order address bits can be set for the same read-out address independent of memory bank.

Further, it is desirable to configure the image display apparatus described above in units which display one part of the entire image data. In this manner, the entire image of a large-scale display can easily be assembled from a plurality of these display units.

Further, the image display apparatus of the present invention is provided with:

(a) a display section made up of a plurality of light emitting devices arranged in an m-line by n-column matrix;

(b) a vertical driver section which sequentially selects each line of the display section and sources current to each line;

(c) a horizontal driver section which supplies driving current to each column of the display section according to image data corresponding to the selected line;

(d) an image data correction section which corrects externally input image data according to variations in light emitting device characteristics for each pixel, and outputs corrected data to the horizontal driver section; and (e) a correction data memory section to hold correction data for image data correction.

The image data correction section reads out one line of correction data from the correction data memory section each time it outputs one line of corrected image data to the horizontal driver section. In this system, the amount of correction data that must be temporarily retained in the image data correction section can be reduced, large amount of memory such as random access memory (RAM) does not need to be used as buffer memory, and image data can be corrected via simple circuit structure.

The image data correction section of the image display apparatus of the present invention is provided with buffer memory to store at least one line of correction data. The image data correction section can read out the next line of correction data from the correction data memory section while it outputs one line of corrected image data to the horizontal driver section. This prevents any display time lag between lines due to image data correction.

In the image display apparatus of the present invention, shift registers can be provided as buffer memory, and correction data can be read via the shift registers by direct sequential shifting one bit at a time. This eliminates the need for data bus line branching to transfer correction data to buffer memory in the correction data memory section, and it also eliminates the need for an address bus to select buffer memory. Therefore, wiring area can be reduced and wiring layout options can be increased.

Still further, in the image display apparatus of the present invention, two stages of interconnected registers can be provided as buffer memory. When the first register outputs one line of correction data, the next line of correction data is read into the second register. Each time output and input of one line of correction data is completed, correction data from the second register can be transferred to the first register. With this system, image data can be corrected with a simple circuit structure.

In the image display apparatus described above, the second register can be a shift register, and correction data can be read by direct sequential shifting one bit at a time. This eliminates the need for data bus line branching to transfer correction data, and it also eliminates the need for an address bus to select buffer memory.

The image display apparatus of the present invention can use LEDs as the light emitting devices. In this image display apparatus, LED display peripheral circuit structure can be simplified and the display apparatus can made compact.

Finally, the image display apparatus of the present invention can display images by dividing the entire image into parts. Since the image display apparatus of the present invention can simplify peripheral circuit structure, it is suitable for use in image data units which display part of an entire image, for example, it is suitable for LED units used in large-scale LED displays.

DETAILED DESCRIPTION OF THE INVENTION

Figure 1:
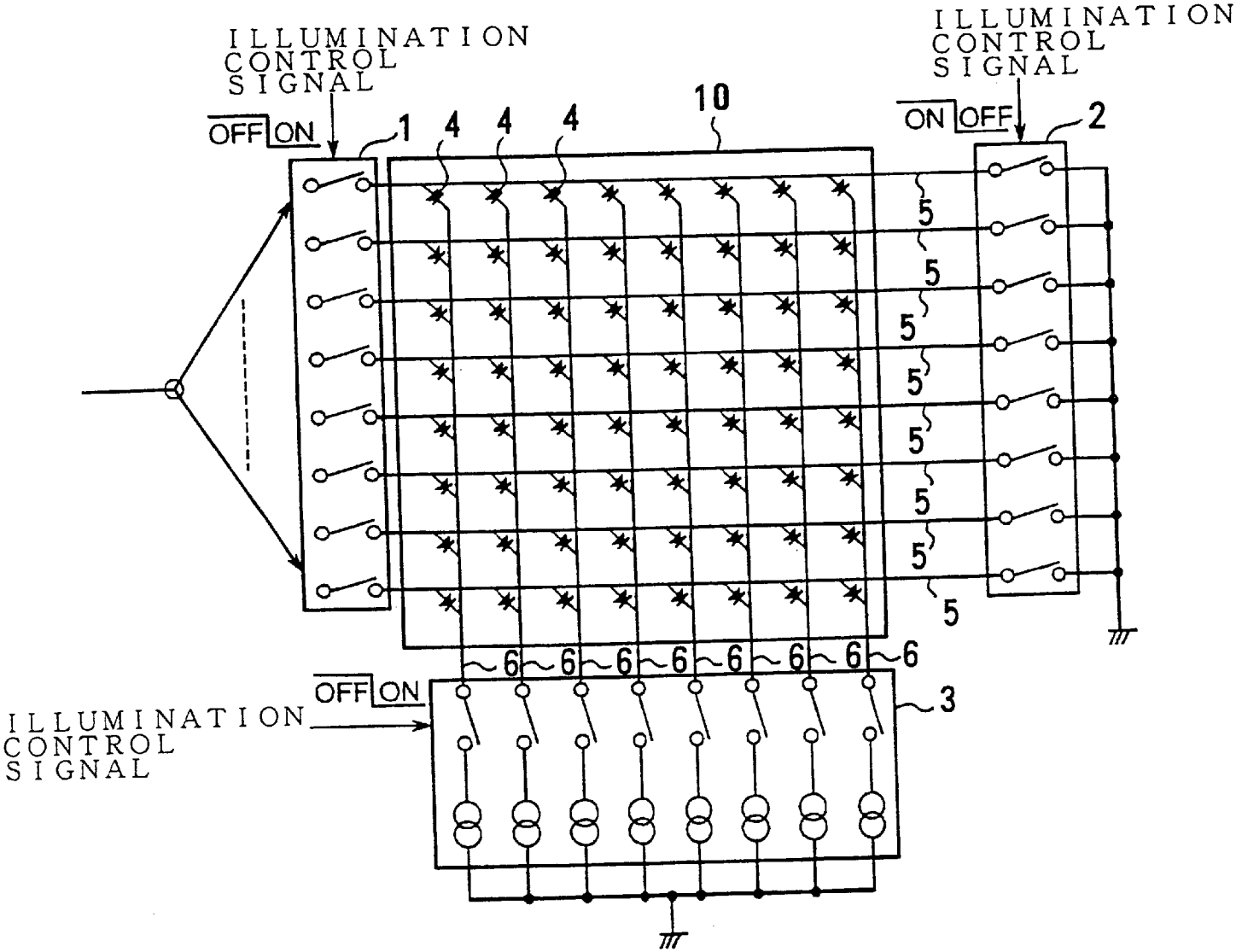
FIG. 1. is a conceptual drawing showing the structural format of the image display apparatus of an embodiment of the present invention.

FIG. 1 is a conceptual drawing illustrating an image display apparatus provided with a switching circuit section to discharge accumulated charge in the dot matrix. The display apparatus of FIG. 1 is provided with an LED dot matrix 10, a current source switching circuit 1, a constant current control circuit section 3, and a switching circuit section 2. The display apparatus of FIG. 1 uses LEDs as light emitting devices, but devices other than LEDs may also be used as the light emitting devices.

(1) The LED dot matrix 10 is a plurality of LEDs 4 arranged in an m-line, n-column matrix. The cathode of each LED 4 in each column is connected to a current line 6. The anode of each LED 4 in each line is connected to a common source line 5.

(2) The current source switching circuit 1 is provided with m-switching circuits which correspond to, and are connected to, each respective common source line 5. The current source switching circuit 1 connects a current source to the common source line 5 selected by the address signal for the illumination period specified by the input illumination control signal. This supplies current to the LEDs 4 connected to the selected common source line 5.

(3) The constant current control circuit section 3 is provided with memory circuits to store n-sets of sequentially input pixel level data. The constant current control circuit section 3 drives the current lines with a pixel level width, corresponding to the pixel level data stored in each memory circuit, over the time interval specified by the input illumination control signal.

(4) The switching circuit section 2 floats the opposite end of each common source line over the illumination time interval of the input illumination control signal, and grounds the opposite end of each common source line during the off interval (non-illumination interval) of the input illumination control signal.

In a display apparatus with the above configuration, on-off switching of the current source switching circuit 1, the constant current control circuit section 3, and the switching circuit section 2 are all performed according to the illumination control signal. During the illumination interval of the illumination control signal, the current source switching circuit 1 and the constant current control circuit section 3 are activated, while the switching circuit section 2 is deactivated (each switch connected to the opposite end of a common source line is off). When activated, the current source switching circuit 1 connects a common source line selected by the input address signal to the current source. At this time, the constant current control circuit section 3 drives the current lines with a pixel level width corresponding to pixel level data stored in each memory circuit. In this manner, LEDs 4 connected to the common source line selected by the address signal are illuminated with the pixel level width corresponding to the associated pixel level data. Further, in the deactivated state, both the current source switching circuit 1 and the constant current control circuit section 3 are deactivated, while the switching circuit section 2 is activated. Consequently, during off intervals indicated by the illumination control signal, charge accumulated by each LED or its associated connections is discharged to ground via each closed switch in the switching circuit section 2. Therefore, each LED and its associated connections do not accumulate charge under these conditions.

Subsequently, illumination intervals and off intervals are sequentially repeated. LEDs disposed in each line are sequentially illuminated during each illumination interval, and the desired image is displayed on the LED dot matrix. With this system, charge accumulated by LEDs (or their associated connections) which are not illuminated during an illumination interval, is discharged during the next off interval. Consequently, during the illumination interval, LED illumination can be controlled with each LED and its associated connections always in a discharged state with no unwanted charge build-up.

Accordingly, the display apparatus of FIG. 1 can obtain sufficient image contrast, and high quality display is possible. This is because illumination control can be accomplished without the effects of charge accumulation.

Figure 2:
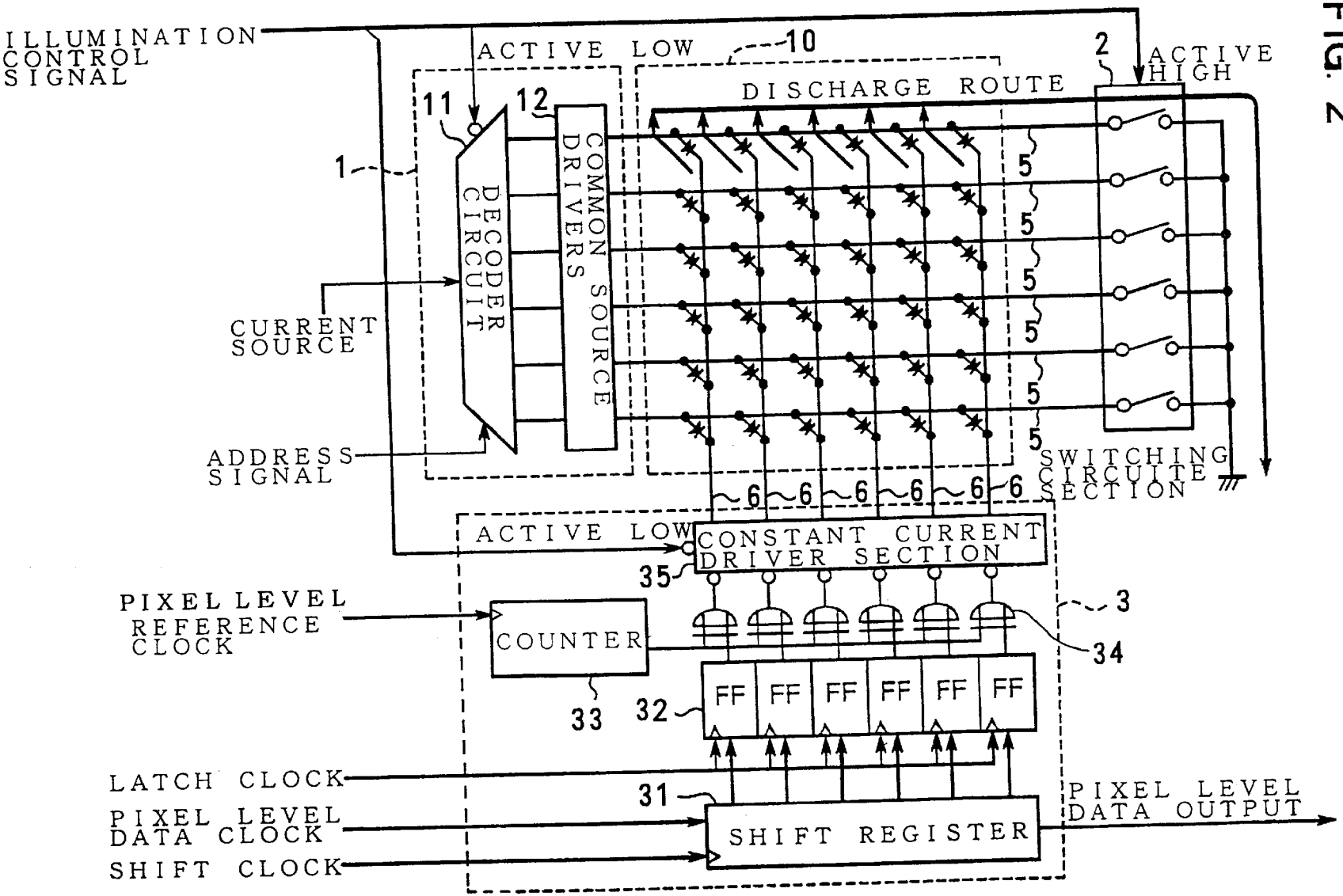
FIG. 2. is a block diagram showing a specific example of the image display apparatus shown in FIG. 1.

Turning to FIG. 2, the following describes a specific configuration of the display apparatus of the present invention. In FIG. 2, items which are the same as those in FIG. 1 are labeled with the same part number.

As shown in FIG. 2, the current source switching circuit 1 of this specific embodiment comprises a decoder circuit 11 and common source drivers 12. When the illumination control signal is in a digital signal low state (LOW), the decoder circuit 11 controls the common source drivers 12 on or off for current source connection to the common source line 5 selected by the address signal. When the illumination control signal is in a digital signal high state (HIGH), the current source switching circuit 1 controls the common source drivers 12 via the decoder circuit 11 to disconnect all common source lines from the current source.

When the illumination control signal is LOW, this type of current source switching circuit 1 connects only the common source line 5 of the LED dot matrix 10 selected by the address signal to the current source.

The constant current control circuit section 3 is provided with a shift register 31, memory circuits 32, a counter 33, data comparitors 34, and a constant current driver section 35. In this type of constant current control circuit section 3, pixel level data are shifted n-times by the shift register in synchronization with a shift clock. Pixel level data corresponding to each of the n-current lines are clocked into, and stored in, respective memory circuits 32 in response to a latch clock signal. When the illumination control signal is LOW, the output signal from data comparitors 34 is input to the constant current driver section 35. The data comparitors compare pixel level data with the value output from a counter 33 clocked by a pixel level reference clock used as the counter clock. The constant current driver section 35 controls the flow of constant current in each current line for a driver pulse width interval corresponding to the pixel level data value.

As described above, the current source switching circuit 1 and the constant current control circuit section 3 perform LED display pixel level control when the illumination control signal is LOW. When the illumination control signal is HIGH, the LED dot matrix is not connected to the current source switching circuit 1 or the constant current control circuit section 3.

When the illumination control signal is HIGH, the switching circuit section 2 turns on switches to ground all common source lines 5. When the illumination control signal is LOW, switches are turned off to disconnect (float) all common source lines 5.

The display apparatus of FIG. 2 configured as described above drives the LED dot matrix 10 with constant current to illuminate prescribed LEDs when the illumination control signal is LOW. When the illumination control signal is HIGH, constant drive of the LED dot matrix 10 is suspended. In this state, accumulated residual charge in each LED of the LED dot matrix 10 and its associated connections is discharged via the switching circuit section 2.

The embodiment of FIG. 2 described above is organized to drive the LED dot matrix 10 with constant current when the illumination control signal is LOW, and to turn the switching circuit section 2 on when the illumination control signal is HIGH. However, the present invention is not restricted to this system, and control may also be performed with the LOW level and HIGH level reversed.

Figure 3:
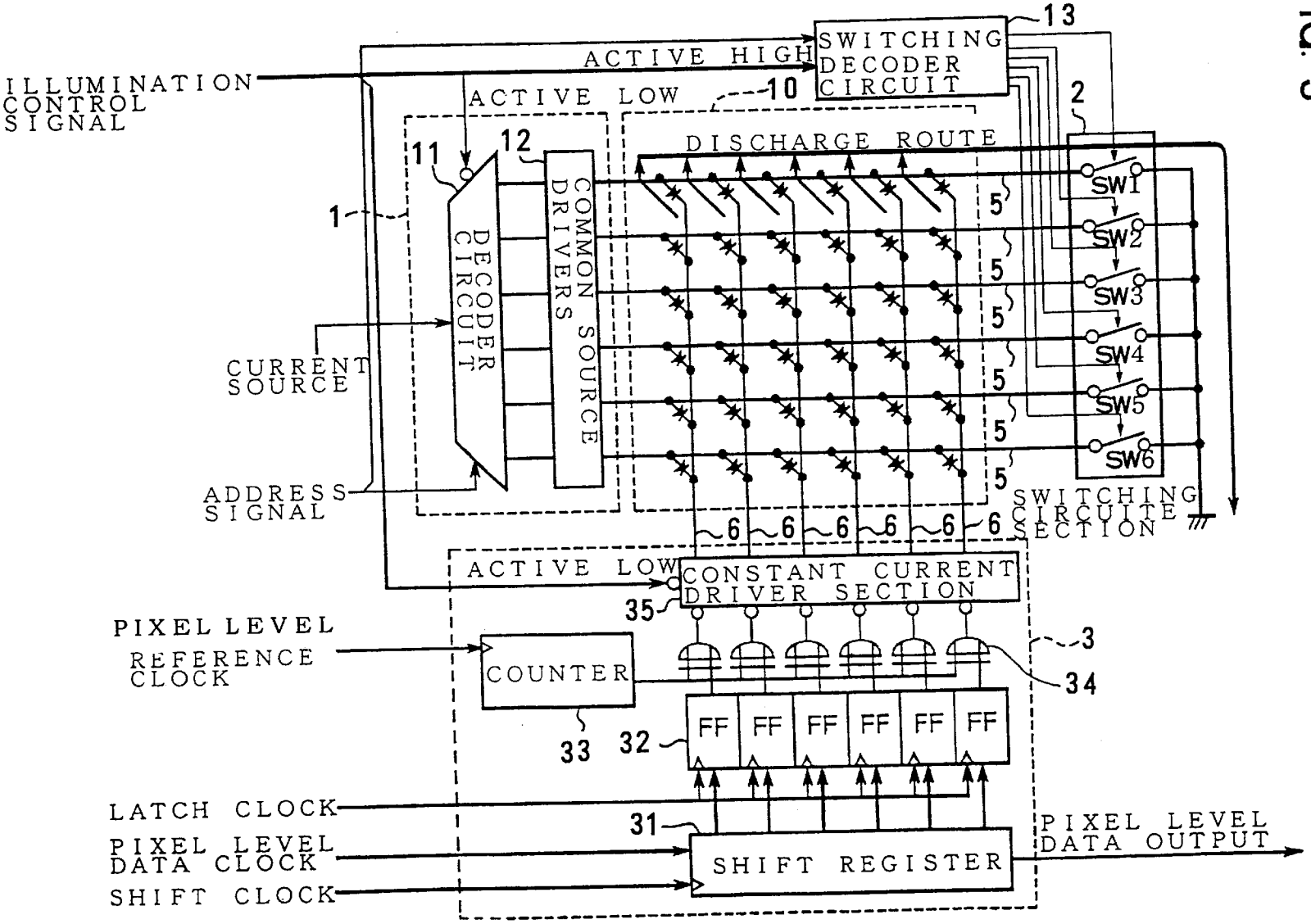
FIG. 3. is a block diagram showing another specific example of the image display apparatus.

Turning to FIG. 3, another embodiment of the image display apparatus of the present invention is shown. Elements of FIG. 3 which are the same as those of FIGS. 1 and 2 are labeled with the same part number. The image display apparatus shown in FIG. 3 is provided with a switching decoder circuit 13, which separately controls each switch SW1–6 of the switching circuit section 2. The switching decoder circuit 13 controls each switch SW1–6 of the switching circuit section 2 ON and OFF based on input signals such as the address signal and the illumination control signal. When the illumination control signal is logic HIGH, the switching decoder circuit 13 controls only the switch selected by the address signal ON to ground only the common source line connected to that switch. At this time, all remaining switches not selected by the address signal are OFF, and all remaining common source lines connected to those switches are left floating. the illumination control signal. When the illumination control signal is logic HIGH, the switching decoder circuit 13 controls only the switch selected by the address signal ON to ground only the common source line connected to that switch. At this time, all remaining switches not selected by the address signal are OFF, and all remaining common source lines connected to those switches are left floating.

Figure 4:
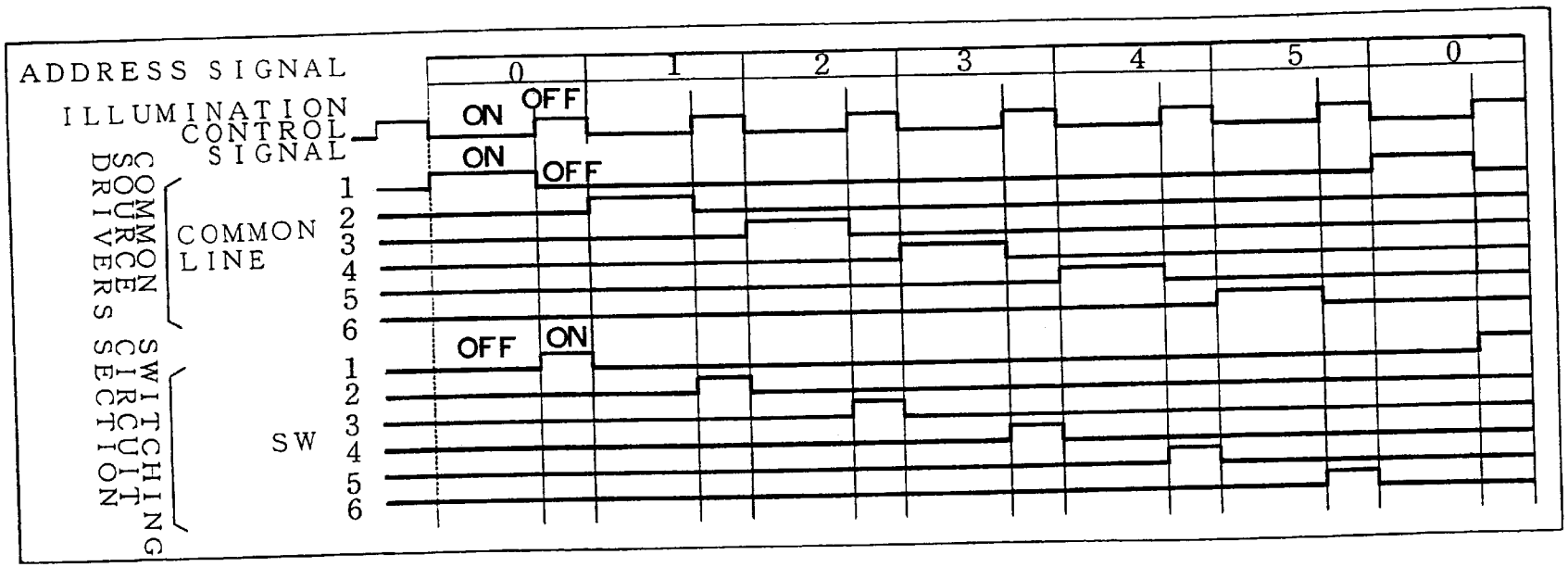
FIG. 4 is a timing diagram showing common source driver and switching circuitry control for the image display apparatus shown in FIG. 3

The timing diagram of FIG. 4 shows display apparatus control for the current source switching circuit 1 common source drivers 12 and for each switch SW1–6 of the switching circuit section. The common lines 1–6 shown in FIG. 4 are the common source lines connected to the corresponding switches SW1–6 of the switching circuit section 2.

As shown in FIG. 4, when the illumination control signal is logic LOW, the current source switching circuit 1 controls the common source drivers 12 to connect only the common source line 5 selected by the address signal to the current source. Further, when the illumination control signal is logic HIGH, the switching decoder circuit 13 turns only the switch selected by the address signal ON to ground that common source line. For example, when the address signal is 0 and the illumination control signal is LOW, common line 1 is controlled ON, and the current source is connected only to that common source line. At this time, all the switches SW1–6 are controlled OFF. Next, when the address signal is 0 and the illumination control signal goes HIGH, common line 1 is controlled OFF, in addition only SW1 connected to the other end of common line 1 is controlled ON, and only that common source line is grounded. When an illuminated LED goes to the inactive state (not illuminated), the switching decoder circuit 13 immediately controls the switching circuit section 2 to ground the common source line connected to that LED. This is done to effectively prevent accumulation of charge when an illuminated LED is turned OFF.

In the manner described above, common source lines 1–6 and switches SW1–6 are selected according to the address signal, and the selected common source lines and switches are controlled ON or OFF by LOW and HIGH logic levels of the illumination control signal. By successive repetition of LED illumination and common source line grounding, this image display apparatus displays a prescribed image on the LED dot matrix. In this display apparatus, only the switch connected to the selected common source line is turned ON. Therefore, low level current flow through unselected line LEDs is reliably prevented, and low level illumination of these unselected LEDs can be prevented.

Figure 5:
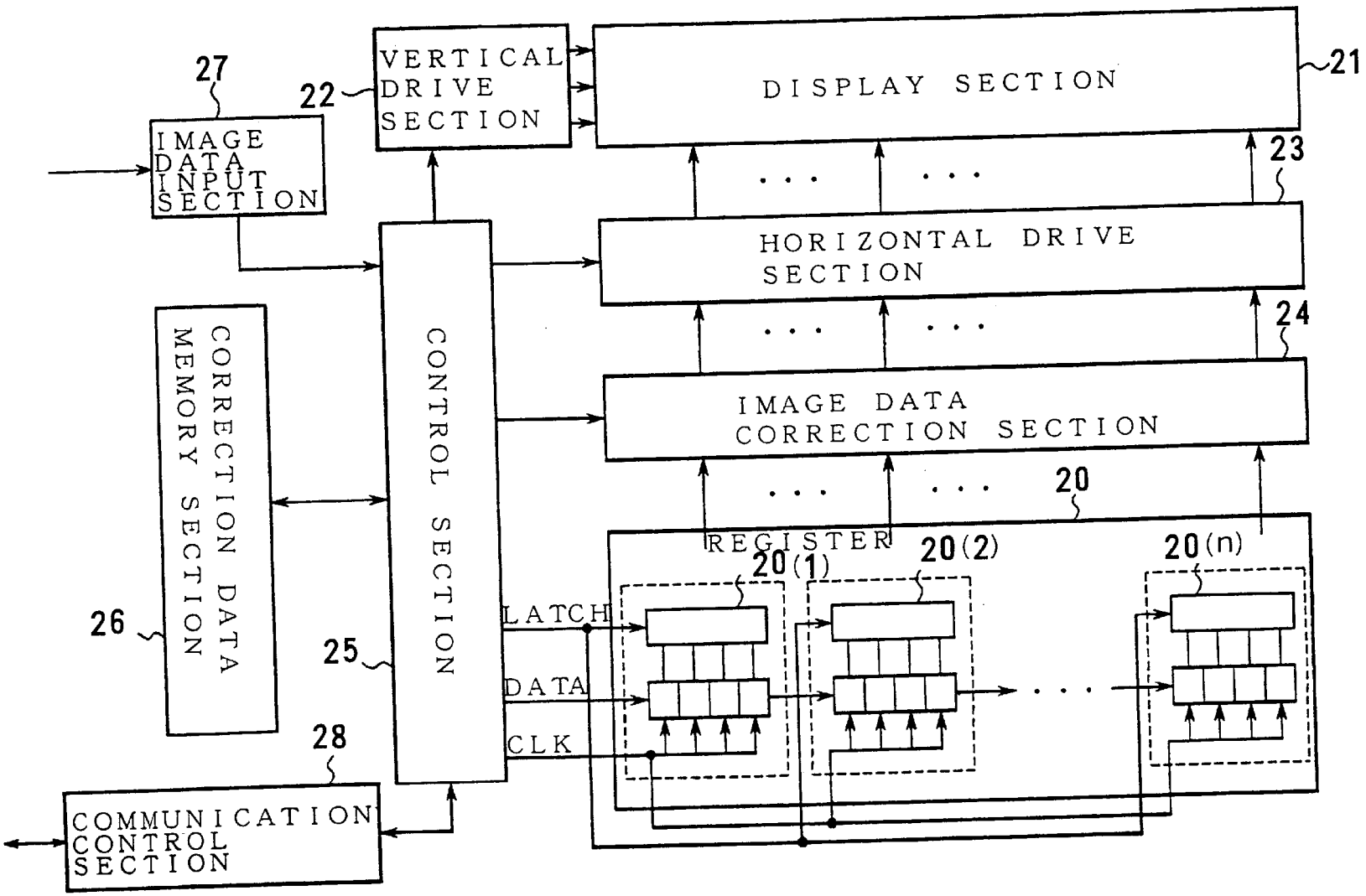
FIG. 5. is a conceptual drawing showing the structural format of the image display apparatus of another embodiment of the present invention.

FIG. 5 is a block diagram showing the overall conceptual structure of an image display apparatus provided with a correction data memory section comprising a read-only first memory bank and a writable second memory bank. The image display apparatus of FIG. 5 is provided with a display section 21 of light emitting devices arrayed in an m-line by n-column matrix, a correction data memory section 26 to store correction data corresponding to each respective light emitting device, and control and driver circuitry to correct input image data based on the correction data and to display an image on the display section 21 using the corrected image data. The control and driver circuitry is provided with a vertical driver section 22, a horizontal driver section 23, image data correction section 24, control section 25, image data input section 27, communication control section 28, and buffer memory 20. In this image display apparatus, image data input to the image data input section 27 are transferred to the control section 25.

The correction data memory section 26 connected to the control section 25 has a first memory bank and a second memory bank. For example, the correction data memory section 26 may be an EEPROM (non-volatile memory in which data can be electrically erased or re-written). First correction data, such as data to correct brightness variation for each pixel are stored in the first memory bank. Second correction data are stored in the second memory bank.

In the present embodiment, brightness variation correction data are used as an example of correction data, but the present invention is not restricted to this type of correction data.

The image data correction section 24 corrects image data for each pixel input via the image data input section 27 and the control section 25 according to first correction data or second correction data for each respective pixel input from the control section 25 and buffer memory 20. The image data correction section 24 outputs this corrected data to the horizontal driver section 23 as pixel level data corresponding to each pixel. The buffer memory 20 for this image display apparatus embodiment has (1) through (n) memory units 20 corresponding to each of 1 through n columns.

The horizontal driver section 23 is provided with n memory units corresponding to each of the n columns. Input pixel level data corresponding to each pixel are stored in memory provided for the column containing that pixel. The horizontal driver section 23 drives a prescribed current line for the pixel level width corresponding to the pixel level data stored in memory in response to a control signal from the control section 25.

Further, the vertical driver section 22 is provided with m-switching circuits connected to each of the m-common source lines. The vertical driver section 22 connects a current source to a specified common source line according to a control signal from the control section 25.

As described above, the control section 25 reads first correction data or second correction data from the correction data memory section 26 and stores the data in buffer memory 20. The control section 25 also controls data input-output timing for buffer memory 20 and the image data correction section 24. The control section 25 also controls switching to connect common source lines with the current source in the vertical driver section 22. Finally, the control section 25 controls switching to drive current lines in the horizontal driver section 23. In this manner, the control section 25 sequentially illuminates each pixel in the display section 21 and displays an image corresponding to the input image data on the display section 21.

In particular, the image display apparatus of the present embodiment has the following features.

(1) The correction data memory section 26 is provided with a first memory bank containing pre-stored first correction data corresponding to each pixel, and a second re-writable memory bank.

(2) The image display apparatus is provided with a communication control section 28. The communication control section 28 allows writing of second correction data, which are different than first correction data, to the second memory bank, and forbids writing to the first memory bank.

(3) The control section 25 can select either first correction data stored in the first memory bank or second correction data stored in the second memory bank, and store it in buffer memory 20.

Consistent with these features, the image display apparatus of FIG. 5 can use the re-writable second memory bank to store second correction data, which are different than first correction data, while avoiding erasure of first correction data retained in the first memory bank. Consequently, it is possible to correct image data depending on requirements by selecting either first correction data or second correction data.

Figure 6:
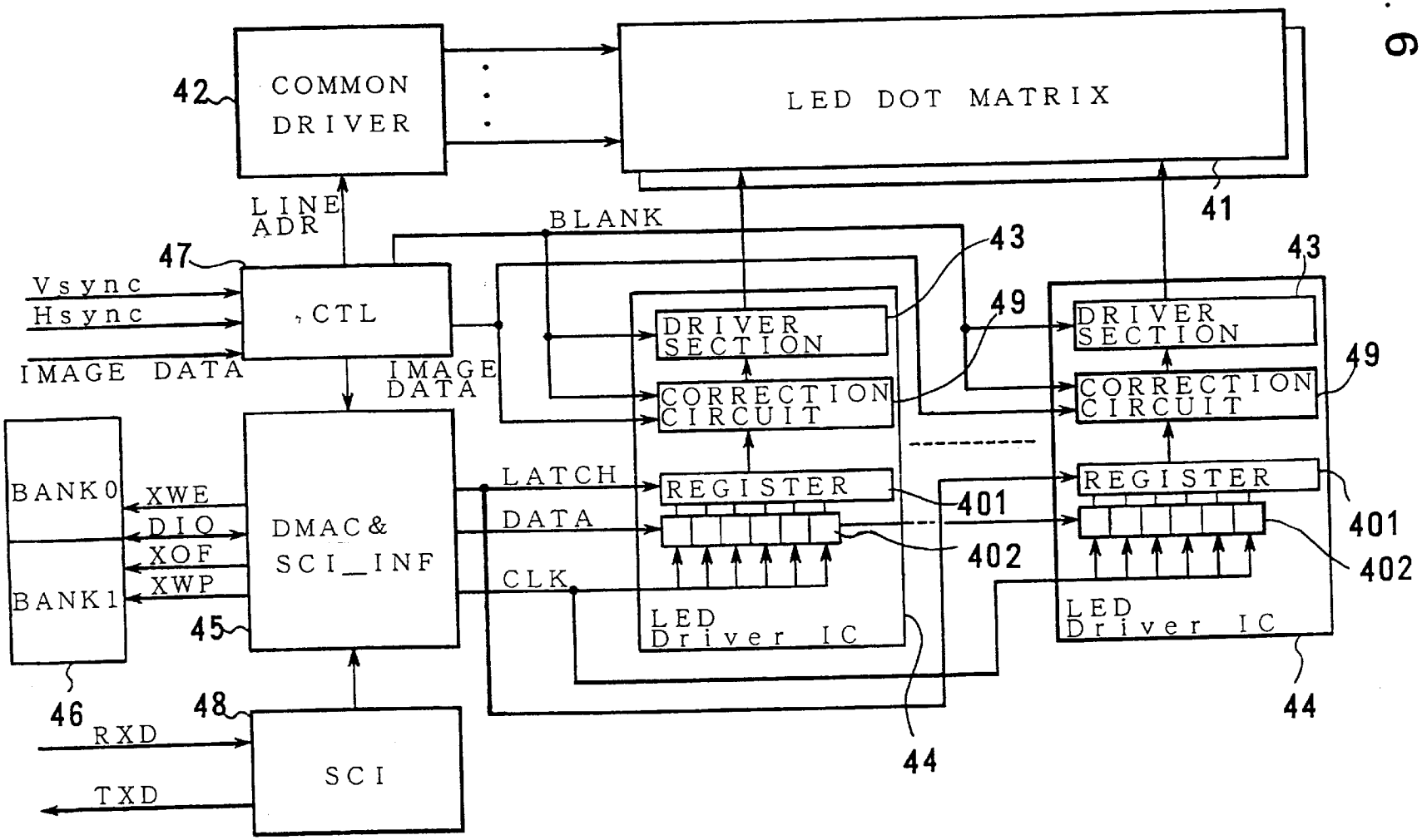
FIG. 6. is a block diagram showing a specific example of the image display apparatus shown in FIG. 5.

Embodiment (brightness correction data two bank correction control circuit, FIG. 6)

The following describes an embodiment of the image display apparatus of the present invention with reference to FIG. 6. The image display apparatus of the present embodiment is provided with an LED dot matrix 41 as the display section, a common driver 42 as the vertical driver section, EEPROM 46 as the correction data memory section, the correction circuit 49 of LED driver IC's 44 as the image data correction section, the driver section 43 of LED driver IC's 44 as the horizontal driver section, a command control section 47 and control section 45 as the control section, a serial communication interface 48 as the communication control section, and the shift register 402 and register 401 of LED driver IC's 44 as the buffer memory.

The command control section 47 inputs a common source line selection signal, LINE ADR, to the common driver 42 and an illumination control signal, BLANK, to each driver section 43 and correction circuit 49.

In the present embodiment, the EEPROM 46 comprises, for example, a BANK0, in which correction data are written at the factory at shipping time, and a BANK1, in which the user can write correction data after shipping. The control section 45 selects correction data from either BANK0 or BANK1 in response to a control signal from the serial communication interface 48. In this embodiment, write-protect settings are made to forbid the user from re-writing data to BANK0, in which correction data are written at the factory at shipping time.

The serial communication interface 48 in this embodiment performs various processing according to commands embedded in received signals. Control of reading and writing to the EEPROM 46 is described below.

Figure 7:
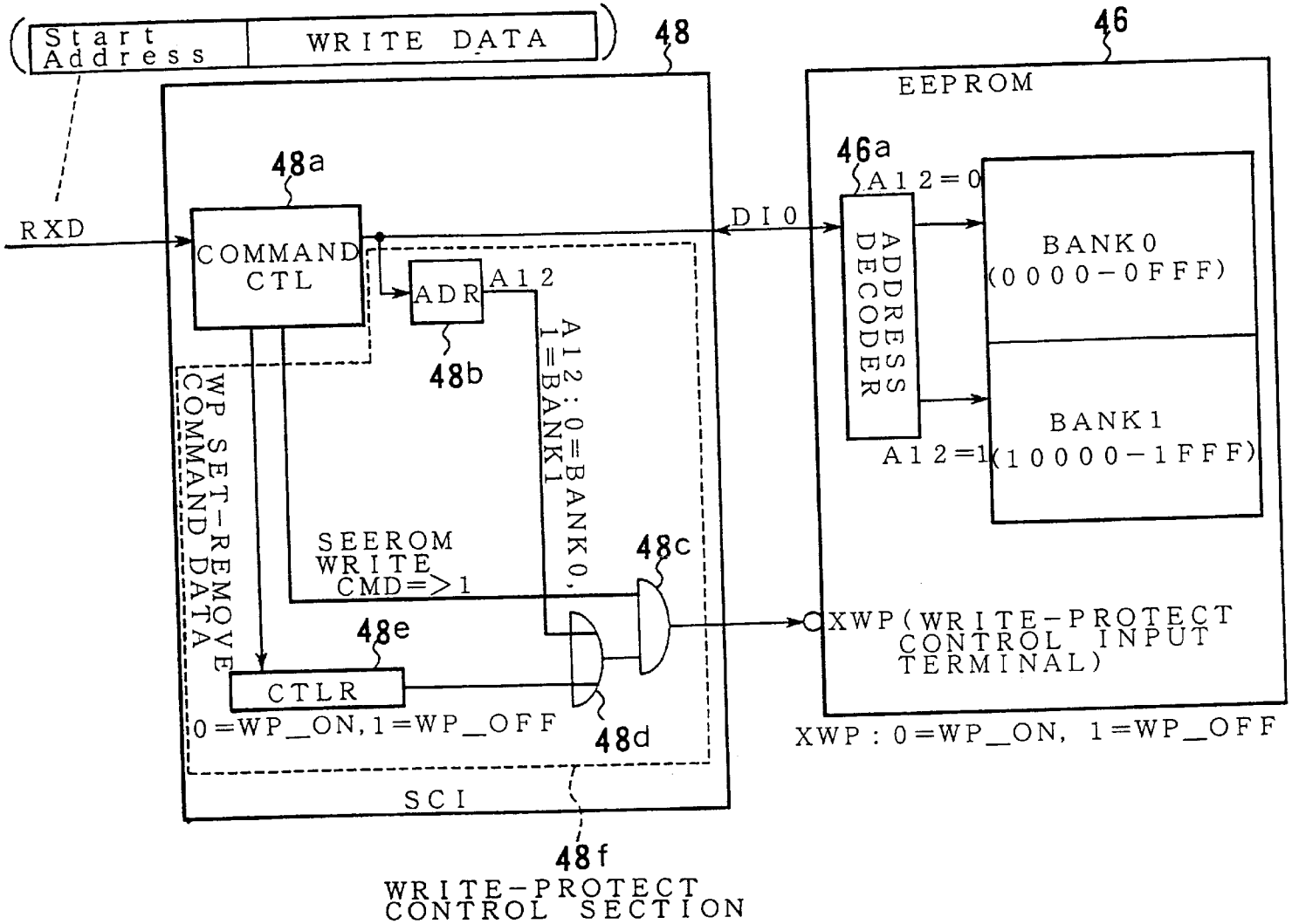
FIG. 7. is a block diagram showing the detailed structure of an electrically erasable programmable ROM (EEPROM) and serial communication interface for the specific example of FIG. 6.

The following details EEPROM 46 structure and the serial communication interface 48 configuration for controlling EEPROM 46 reading and writing. As shown in FIG. 7, the serial communication interface 48 is configured with a write-protect control section 48*f* comprising an address register 48*b*, a control register 48*e*, and AND logic circuits 48*c* and 48*d*, in addition to a command control 48*a*.

The input signal, RXD, to the serial communication interface 48 includes commands, which instruct data to be written to the EEPROM 46 (write commands), and writable communication data, which are input to the command control section 48*a*. As shown in FIG. 7, the writable communication data includes starting address data (Start Address in FIG. 7) specifying the location to write data to, and the data to be written (WRITE DATA in FIG. 7).

When an RXD input signal containing a write command is received by the serial communication interface 48, the command control section 48*a* outputs command data to remove write-protection (WP set-remove command data) to the control register 48*e*. The command control section 48*a* also outputs the highest order bit, A12, of the starting address data to the address register 48*b*, and a logic 1 to the AND logic circuit 48*c*. Further, the command control section 48*a* outputs the writable communication data to the address decoder 46*a* of the EEPROM 46.

Here, when the highest order bit, A12, is 0, BANK0 is indicated as the ROM area to write to, and when the highest order bit, A12, is 1, BANK1 is indicated as the ROM area to write to.

In the present invention, the EEPROM 46 may comprise two or more memory banks. In the case of more than two memory banks, the highest order two or more bits can be used to indicate the applicable memory bank.

The control register 48*e* is pre-set to the write-protect mode and normally outputs a logic 0 indicating the write-protect mode to the AND logic circuit 48*d*. However, when command data (WP set-remove command data) indicating removal of write-protection are input from the command control section 48*a*, a logic 1 indicating removal of write-protection is output to the AND logic circuit 48*d*.

When a logic 1 is input via the address register indicating BANK1, and the control register 48*e* issues a logic 1 to remove write-protection, the AND logic circuit 48*d* outputs a logic 1 to AND logic circuit 48*c*.

When the command control section 48*a* issues a logic 1 and a logic 1 is input from AND logic circuit 48*d*, AND logic circuit 48*c* outputs a logic 1 to the XWP terminal of the EEPROM 46. At all other times the AND logic circuit 48*c* outputs a logic 0. When a logic 1 is input to the XWP terminal of the EEPROM 46, write-protection is removed (WP-OFF). When a logic 0 is input to the XWP terminal of the EEPROM 46, write-protection is maintained (WP-ON).

The XWP terminal is the write-protect terminal of the EEPROM 46 and data writing is made valid or invalid at this terminal. When XWP=0 (LOW), data writing to the EEPROM is invalid and the write-protect mode is set. When XWP=1 (HIGH), data writing to the EEPROM is valid and the write-protect mode is not set.

Switching between BANK0 and BANK1 at the EEPROM 46 is accomplished by the address decoder 46*a* based on the highest order bit A12 contained in the writable communication data. Further, memory bank selection for read-out is performed in the same manner as for data writing using the highest order bit A12. Namely, memory bank selection can be performed by the EEPROM 46 address decoder 46*a* based on the highest order bit A12 contained in the writable communication data, which are input from the command control section 48*a*.

In FIG. 7, an example of a 13 bit wide address bus is shown, but memory bank selection by the highest order bit can be performed in the same manner for more than 13 bits or less than 13 bits.

In the EEPROM 46 and serial communication interface 48 configuration described above, EEPROM 46 BANK0 correction data are always protected, while BANK1 correction data can be re-written according to the RXD signal. Further, either BANK0 or BANK1 can be selected to read correction data from.

Control of the EEPROM 46 by direct connection of the serial communication interface 48 was described above. However, the EEPROM 46 can be controlled in the same fashion by connection of the serial communication interface 48 to the EEPROM 46 via the intervening control section 45, as shown in FIG. 6. Specifically, each control signal from the serial communication interface 48 to the EEPROM 46 is simply input to the EEPROM 46 via the control section 45 in the same fashion as for direct connection. Correction data read from the EEPROM 46 are branched to the shift registers 402 of the LED driver IC's 44 by the control section 45 connected between the EEPROM 46 and the serial communication interface 48.

Further, the RXD signal received by the serial communication interface 48 may be input from an external controller (not illustrated). As shown in FIG. 6, data such as correction data read from the EEPROM 46 can be transmitted, for example, to an external controller by the serial communication interface 48 as the TXD signal.

In the display apparatus embodiment of FIG. 6 described above, image data, the vertical synchronization signal, Vsync, and the horizontal synchronization signal, Hsync, are input to the control section 47 via an image data input section (not illustrated). Input image data are transferred from the command control section 47 to the LED driver IC 44 correction circuits 49. Further, the vertical synchronization signal, Vsync, and the horizontal synchronization signal, Hsync, are input to the control section 45, the correction circuit 49 and driver section 43 of each LED driver IC 44, and the common driver 42.

The control section 45 controls each element of the display apparatus in synchronization with the input vertical synchronization signal, Vsync, and horizontal synchronization signal, Hsync. Further, correction data read from the EEPROM 46 BANK0 or BANK1 depending on the input signal to the serial communication interface 48, are sequentially transferred to the shift registers 402 according to control section 45 instructions. After one lines-worth of correction data are transferred to the shift registers 402, the data are input to respective correction circuits 49 via corresponding registers 401. Specifically, image data and correction data corresponding to that image data are input to the correction circuits 49.

Image data input to the correction circuits 49 are corrected by the correction circuits 49 according to the correction data. The result is then taken as the pixel level data, and input to each driver section 43. Based on the corrected image data (pixel level data), prescribed LED lines of the LED dot matrix 41 are illuminated by the common driver 42 and each driver section 43 to display an image according to the image data.

In the embodiment of the image display apparatus of present invention described above, correction data stored in BANK0 of the EEPROM 46, for example, correction data written at the factory at shipping time, can be retained without erasure. The re-writable BANK1 can be used, for example, by the user to store correction data revised to account for the environment of operation. Depending on requirements, it is possible to select either correction data set to correct the image data.

Further, in this configuration of the embodiment of the present invention, a single memory device such as an EEPROM can be used instead of providing two memory devices such as a ROM and an EEPROM. Therefore, the structure can be made compact.

In this embodiment, an EEPROM 46 having a write-protect feature (WP function) was described. Write versus read-only control can be achieved for an EEPROM with no WP function by controlling the output state of the write-enable control signal, XWE, which controls timing for EEPROM writing. For example, for the case of an active LOW write-enable pulse, XWE, when the serial communication interface receives write commands in the write-protect mode, the same write-protect feature can be achieved by setting XWE always to logic HIGH.

Specifically, the present invention is not restricted to the structure of the embodiment described above. It is sufficient if the system has at least one correction data memory section, and that correction data memory section is provided with a write-protected area and an area which can be written to.

For image display on a large-scale LED display of the present invention, it is desirable to divide the overall image into parts and implement display on LED units. For example, a large-scale LED display, in which the user has already set the second memory bank for specific operational conditions, may require LED units in one part to be replaced. The second memory bank can be re-written to adjust only for the replaced LED units, and re-adjustment for the user's operational conditions can be accomplished easily.

Again, the present invention is not restricted to an image display apparatus using light emitting diodes.

Figure 8:
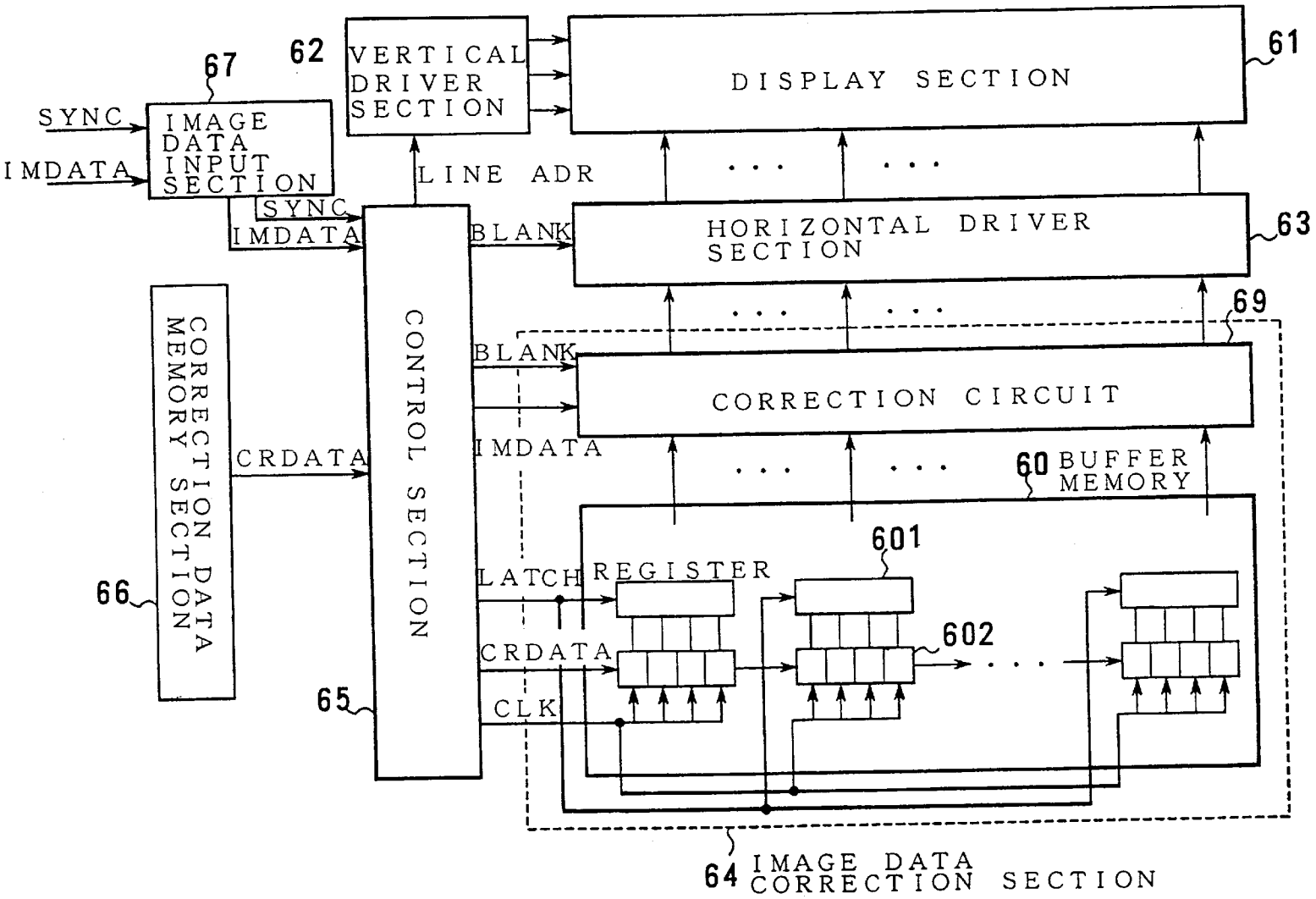
FIG. 8. is a conceptual drawing showing the structural format of the image display apparatus of another embodiment of the present invention.

FIG. 8 is a block diagram outlining an image display apparatus embodiment having an image data correction section which reads one line of correction data from the correction data memory section each time it outputs one line of corrected image data. The image display apparatus shown in FIG. 8 is provided with:

(a) a display section 61 made up of a plurality of light emitting devices arranged in an m-line by n-column matrix;

(b) a vertical driver section 62 which sequentially selects each line of the display section 61 and sources current to each line;

(c) a horizontal driver section 63 which supplies driving current to each column of the display section 61 according to image data corresponding to the selected line;

(d) an image data correction section 64 which corrects externally input image data (IMDATA) according to variations in light emitting device characteristics for each pixel, and outputs corrected data to the horizontal driver section 63; and (e) a correction data memory section 66 which holds correction data for image data correction. Operation of each element of this system is controlled by a control section 65.

The image data correction section 64 reads correction data (CRDATA) from the correction data memory section 66 via the control section 65, corrects image data (IMDATA) input via the control section 65 based on the correction data, and outputs the corrected image data to the horizontal driver section 63. A total of mxn pixels of correction data are not read all at once, but rather correction data are read one line (n pixels) at a time in parallel with output of one line of image data.

For the case of image data for a static image, it is possible to correct the image data without providing any buffer memory at all. However, for the case of image motion, buffer memory which can store one or two lines of correction data is desirable to prevent display time lag between lines. The buffer memory 60 can be configured, for example, as two stages of interconnected registers 601 and 602.

Correction data reading may proceed, for example, in the following manner. The image data correction section 64 is provided with buffer memory 60 made up of two stages (upper and lower) of interconnected registers 601 and 602. When the first register 601 outputs one line of correction data to the correction circuit 69, the next line of correction data is read into the second register 602. When the first register 601 finishes outputting one line of correction data and the second register 602 finishes reading one line of correction data, the contents of the second register 602 are transferred to the first register 601.

An array of D-flip-flops for just one display lines-worth of data (n-pixels times the bit count for one pixel (a)) can be used, for example, as the first register 601 and the second register 602. To simplify correction data input wiring, it is desirable to connect flip-flops of the second register 602 in a master-slave sequence to form a shift register. In this configuration, correction data input to the flip-flop at the left end of the second register 602 is sequentially transferred (shifted) to the right side in sync with clock (CLK) timing, and data are thus read into the second register 602. Therefore, bus line branching to each column for correction data input is unnecessary, and wiring to supply a clock signal to each flip-flop is all that is required.

Figure 9:
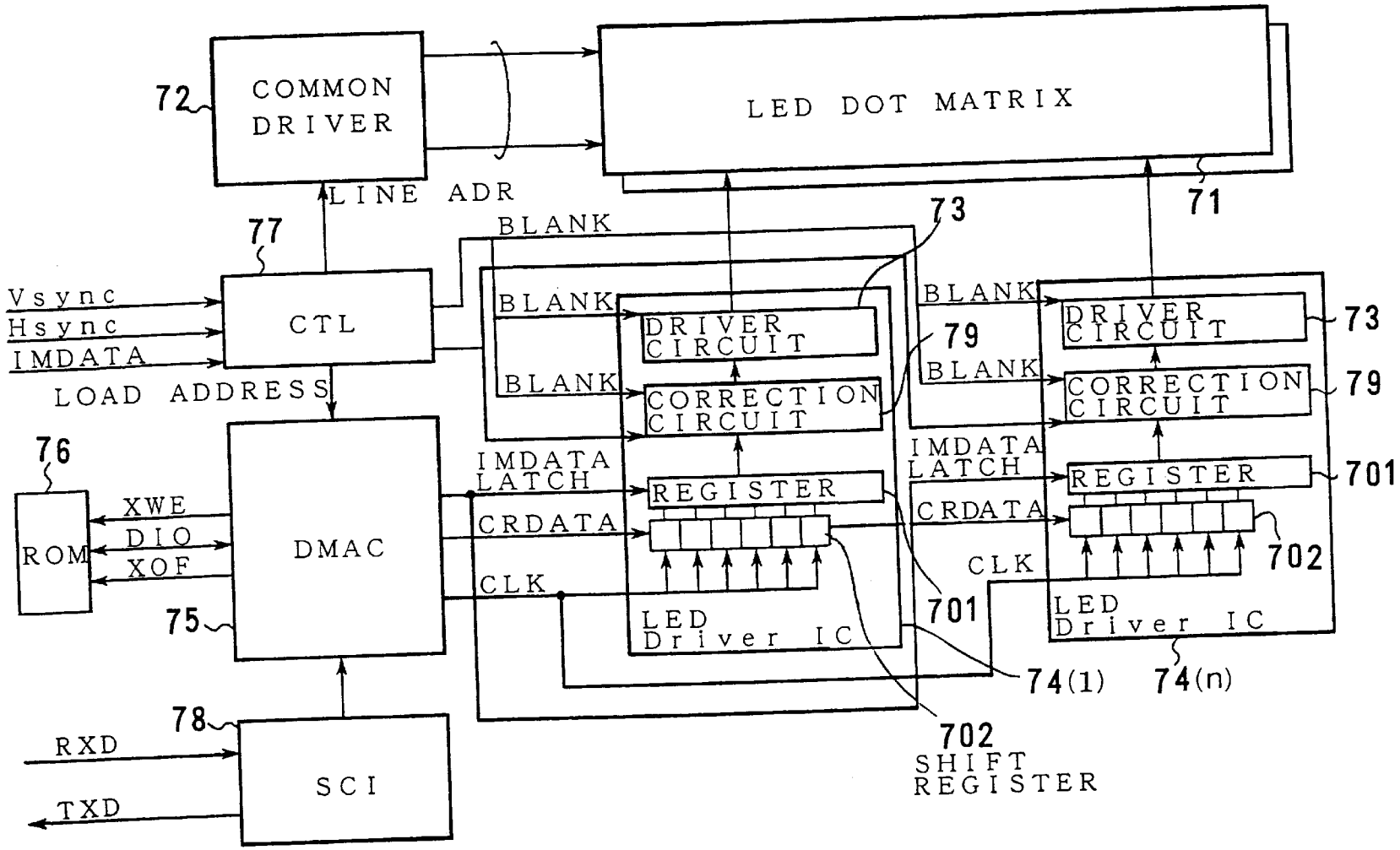
FIG. 9. is a block diagram showing a specific example of the image display apparatus shown in FIG. 8.

FIG. 9 is a block diagram showing detailed structure of the image display apparatus shown in FIG. 8. First, the configuration of each section is described. An LED dot matrix 71, which is the display section, is made up of LEDs arranged in an m-line by n-column matrix. The anodes of all LEDs located in each line are connected to one common source line. The cathodes of all LEDs located in each column are connected together on one current line. A common driver 72, which is the vertical driver section, comprises a current switching circuit provided with m-switching circuits and related current source. The common driver 72 supplies current to LEDs connected to a common source line by connecting the common source line to the current source. Driver circuits 73, which are the horizontal driver section, comprise constant current control circuits which control driving current on and off to each column according to the pixel level width of image data output from the correction circuits 79.

The image data correction section is made up of correction circuits 79, which correct and output sequentially input image data one line at a time, and registers 701 and shift registers 702, which are buffer memory to store correction data. Each register 701 and shift register 702 have flip-flops corresponding to the number of bits for one column of pixels. Further, each flip-flop of register 701 is connected to its corresponding flip-flop in shift register 702. The control section is made up of the control circuit 77 (CTL) and a direct memory access controller (DMAC) 75. ROM 76, which is the correction data memory section, comprises memory such as EEPROM. Brightness correction data to correct for brightness differences due to variation in the light emission characteristics of each LED in the LED dot matrix 71 are stored in ROM 76. Correction data are data to control driving current to each LED according to each pixel and each color. Data to control LED illumination time or a combination of illumination time and driving current, instead of driving current alone, are also suitable data.

A driver circuit 73, correction circuit 79, register 701, and shift register 702 are provided for each column of the LED dot matrix 71, and are contained within an LED driver IC (k) for each column (k=1 to n). Shift registers 702 for each column are connected together to allow data shifting. Further, to reduce the number of LED driver IC's, driver circuits, etc. for an appropriate number of columns can be combined into one LED driver IC.

Writing to, and reading from, the correction data ROM 76 can be performed independent from image data transmission via SCI 78, which is a serial communication interface. Writing to the ROM 76 may also be performed by direct connection to the ROM 76 using direct transfer methods, or via various types of interfaces and parallel buses. When data are to be written to the ROM 76 while correction data are being read from the ROM 76, data transfer by the DMAC 75 is interrupted, and data reception through the SCI 78 is given priority. This allows control of competition for ROM 76 access.

The flow of image data in this type of embodiment proceeds as follows. Image data (IMDATA) are input to the CTL 77 and distributed to the correction circuits 79. After each line of image data is corrected by the correction circuits 79, it is output to the driver circuits 73.

Figure 10:
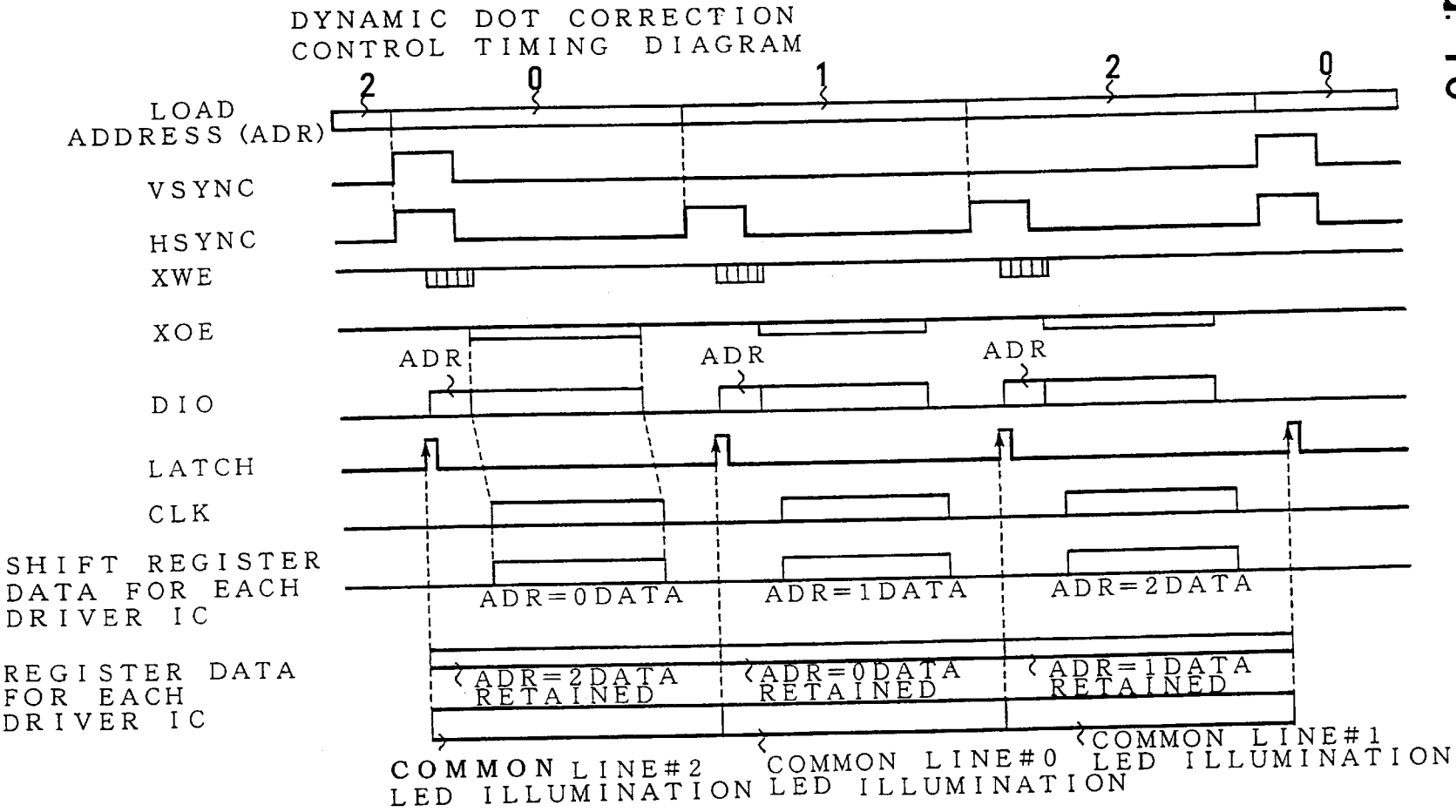
FIG. 10. is a timing diagram showing correction data transmission timing for the image display apparatus shown in FIG. 9.

Next, the flow of correction data is described with reference to the timing diagram of FIG. 10. For simplification, FIG. 10 illustrates the case of illumination of three common source lines #0 through #2 in that order.

Line #0 correction data begins to be read into the shift registers 702 when vertical and horizontal image timing data, Vsync and Hsync, are input to the CTL 77. Vsync input to CTL 77 is transferred to the common driver 72 as the LINE ADR signal, and Hsync is transferred to the driver circuits 73 and the correction circuits 79 as the BLANK signal.

Figure 11:
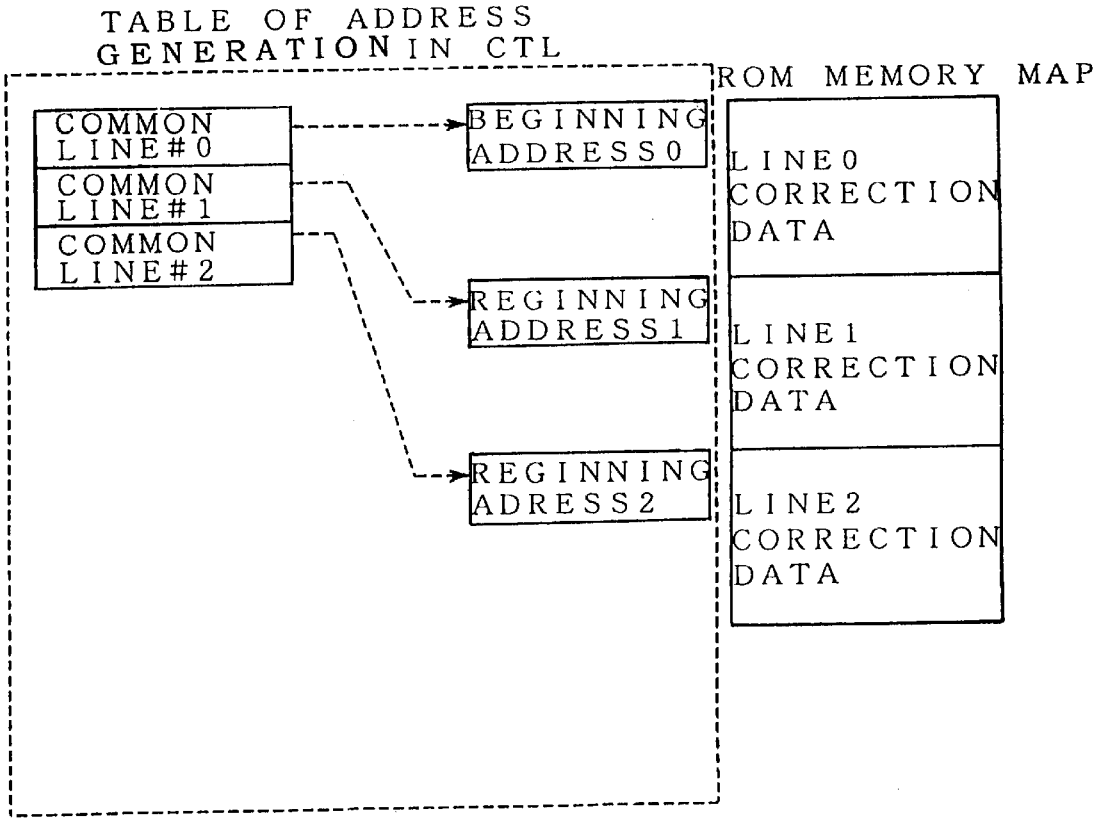
FIG. 11 is an abbreviated drawing showing the relation between control line number and ROM read-out beginning address for the image display apparatus shown in FIG. 9.
Figure 12:
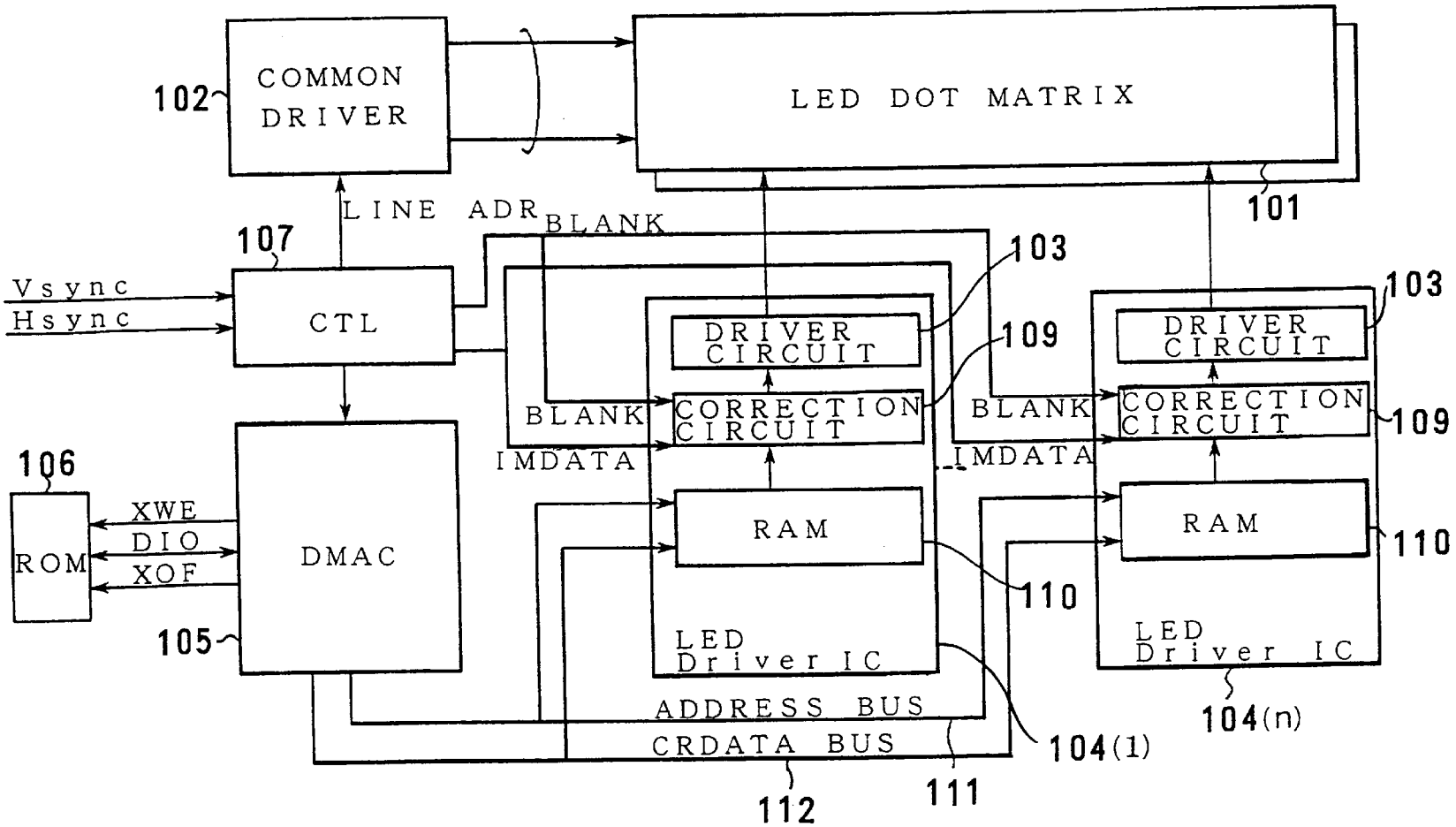
FIG. 12 PRIOR ART
FIG. 12. is a block diagram showing the circuit structure for a related art image display apparatus.

(1) First, the CTL 77 inputs into DMAC 75 the starting address (ADDRESS) for reading line #0 correction data from ROM 76. The DMAC 75 writes to ROM 76 via the data input-output bus DIO the starting address for reading, while issuing a write-enable signal XWE to ROM 76. As outlined in FIG. 11, the starting address for read-out from ROM 76 indicates the beginning address of correction data within the ROM memory map corresponding to the selected line. CTL 77 issues the starting address for reading correction data corresponding to the line number determined from Vsync and Hsync.

(2) After writing the starting address for reading, the DMAC 75 reads line #0 correction data from ROM 76 via the data bus DIO while issuing a read-enable signal XOE. The ROM 76 sequentially outputs correction data corresponding to the LOW pulse count on XOE.

(3) Line #0 correction data (CRDATA) read into DMAC 75 are transferred to shift registers 702 within driver IC's 74 (k). Correction data are transferred sequentially into the shift registers 702 by shifting one bit at a time in synchronization with the clock CLK.

While line #0 correction data are being read into the shift registers 702, registers 701 retain line #2, which is the last line, correction data. Line #2 correction data maintained in registers 701 are output to the driver circuits 73 and line #2 LEDs are illuminated while the correction data are maintained in registers 701.

When the next Hsync pulse is input, a latch signal (LATCH) is issued from the DMAC 75 to the registers 701, line #0 correction data stored in the shift registers 702 are transmitted to registers 701 all at once, and line #0 LED illumination is started. Subsequently, the starting address for reading line #1 correction data is input from the CTL 77 to the DMAC 75. In the same manner described above, the DMAC 75 reads line #1 correction data from ROM 76 and writes it into the shift registers 702.

In this manner, while the previous line is being illuminated, input of data to correct each pixel of the next line to be illuminated is completed. Correction data input to shift registers 702 are transmitted to, and retained in registers 701 just before switching illumination from one line to the next. Based on this retained correction data, the correction circuits 79 correct image data by compensating for brightness variations in each LED of the active display line. By consecutive repetition of these operations, LED brightness correction is achieved over the entire display.

Incidentally, transfer of correction data into shift registers 702 must be completed within the time for illumination of one display line. Therefore, an image display apparatus like a large screen LED display using LED units without too many image data bits per line is suitable for practical implementation of data transfer via shift registers.

Here, a serial EEROM, in which data are read-out in serial fashion, was described as the ROM 76. However, an EEPROM with n-bit address and data busses may also be used as the ROM 76. Further, correction data transfer between the DMAC 75 and shift registers 702 was explained via a serial bus, but data transfer may also be performed via parallel bus.

For the case of a full color LED display, each pixel is made up of three RGB color LEDs. Image data for each respective RGB color can be corrected in the same manner as previously described.

The embodiments described above were presented as separate embodiments to make each characteristic easy to understand. The image display apparatus shown in FIGS. 1 and 2 has a switching circuit section to connect light emitting device common source lines to ground to discharge accumulated charge. The image display apparatus shown in FIGS. 5 and 6 is configured with a correction data memory section having a first memory bank, which stores first correction data and forbids writing to memory, and a second memory bank which can be written to. In the image display apparatus shown in FIGS. 8 and 9, each time one line of corrected image data is output from the image data correction section to the horizontal driver section, the next line of correction data is read from the correction data memory section. However, the most ideal image display apparatus can be realized by an apparatus provided with all of the circuitry described above.

As this invention may be embodied in several forms without departing from the spirit of essential characteristics thereof, the present embodiment is therefore illustrative and not restrictive, since the scope of the invention is defined by the appending claims rather than by the description preceding them, and all changes that fall within the meets and bounds of the claims, or equivalence of such meets and bounds thereof are therefore intended to be embraced by the claims.

What is claimed is:

1. An image display apparatus comprising:

a dot matrix of a plurality of light emitting devices arranged in a matrix with m-lines and n-columns, one terminal of each of the light emitting devices disposed in each column is connected to a respective current line, and the other terminal of each of the light emitting devices disposed in each line is connected to a respective common source line;

driver circuitry operable to control an activation state to be either active or inactive depending on an input illumination control signal and, in the active state, control conduction through one end of each common source line and each current line based on input display data; and a switching circuit section operable to float the other end of each common source line in the active state, and to ground the other end of each common source line in the inactive state;

wherein said driver circuitry is provided with a current source switching circuit with m-switching circuits corresponding to each common source line and, in the active state, said current source switching circuit is operable to connect the common source line selected by an input address signal to the current source; and wherein said driver circuitry is provided with a constant current control circuit section having memory circuits operable to store n-sets of pixel level data of the sequentially input display data and, in the active state, said constant current control circuit section is operable to put the related current line in the conducting state for a pixel level width corresponding to the pixel level data stored in each of said memory circuits.

2. An image display apparatus as recited in claim 1, wherein said switching circuit section is a plurality of switches connected between each common source line and ground.

3. An image display apparatus as recited in claim 2, wherein said switching circuit section is controlled by the illumination control signal which controls a state of light emitting device illumination to be on or off, wherein in the illumination on state, said switches of said switching circuit section are turned off to disconnect the common source line from ground, and wherein in the illumination off state, said switches of said switching circuit section are turned on to connect the common source line to ground.

4. An image display apparatus as recited in claim 1, wherein said switching circuit section is controlled by the illumination control signal which controls a state of light emitting device illumination to be on or off, wherein in the illumination on state of the illumination control signal, said switching circuit section is operable to disconnect the common source line from ground, and wherein in the illumination off state, said switching circuit section is operable to connect the common source line to ground.

5. An image display apparatus as recited in claim 1, wherein said switching circuit section is operable to disconnect the common source line from ground for a logic LOW illumination control signal for light emitting device activation, and connect the common source line to ground for a logic HIGH illumination control signal for light emitting device deactivation.

6. An image display apparatus comprising:

a dot matrix of a plurality of light emitting diodes (LEDs) arranged in a matrix with m-lines and n-columns, a cathode of each of the LEDs disposed in each column is connected to a respective current line, and an anode of each of the LEDs disposed in each line is connected to a respective common source line;

driver circuitry operable to control an activation state to be either active or inactive depending on an input illumination control signal and, in the active state, control conduction through one end of each common source line and each current line based on input display data; and a switching circuit section operable to float the other end of each common source line in the active state, and to ground the other end of each common source line in the inactive state;

wherein said driver circuitry is provided with a current source switching circuit with m-switching circuits corresponding to each common source line and, in the active state, said current source switching circuit is operable to connect the common source line selected by an input address signal to the current source; and wherein said driver circuitry is provided with a constant current control circuit section having memory circuits operable to store n-sets of pixel level data of the sequentially input display data and, in the active state, said constant current control circuit section is operable to put the related current line in the conducting state for a pixel level width corresponding to the pixel level data stored in each of said memory circuits.

7. An image display apparatus as recited in claim 6, wherein said switching circuit section is a plurality of switches connected between each common source line and ground.

8. An image display apparatus as recited in claim 7, wherein said switching circuit section is controlled by the illumination control signal which controls a state of LED illumination to be on or off, wherein in the illumination on state, said switches of said switching circuit section are turned off to disconnect the common source line from ground, and wherein in the illumination off state, said switches of said switching circuit section are turned on to connect the common source line to ground.

9. An image display apparatus as recited in claim 6, wherein said switching circuit section is controlled by the illumination control signal which controls a state of LED illumination to be on or off, wherein in the illumination on state of the illumination control signal, said switching circuit section is operable to disconnect the common source line from ground, and wherein in the illumination off state, said switching circuit section is operable to connect the common source line to ground.

10. An image display apparatus as recited in claim 6, wherein said switching circuit section is operable to disconnect the common source line from ground for a logic LOW illumination control signal for LED activation, and connect the common source line to ground for a logic HIGH illumination control signal for LED deactivation.

11. An image display method comprising:

providing a dot matrix of a plurality of light emitting devices to be arranged in a matrix with m-lines and n-columns such that one terminal of each of the light emitting devices disposed in each column is connected to a respective current line, and the other terminal of each of the light emitting devices disposed in each line is connected to a respective common source line;

controlling an activation state to be either active or inactive depending on an input illumination control signal and, in the active state, controlling conduction through one end of each common source line and each current line based on input display data; and floating the other end of each common source line in the active state, and grounding the other end of each common source line in the inactive state;

connecting, in the active state, the common source line selected by an input address signal to the current source; and storing n-sets of pixel level data of the sequentially input display data and, in the active state, putting the related current line in the conducting state for a pixel level width corresponding to the stored pixel level data.

12. An image display method as recited in claim 11, wherein said floating is achieved by providing a plurality of switches to be connected between each common source line and ground.

13. An image display method as recited in claim 12, wherein the illumination control signal controls a state of the light emitting device illumination to be on or off, wherein in the illumination on state, the switches are turned off to disconnect the common source line from ground, and wherein in the illumination off state, the switches are turned on to connect the common source line to ground.

14. An image display method as recited in claim 11, wherein the illumination control signal controls a state of the light emitting device illumination to be on or off, wherein in the illumination on state of the illumination control signal, the common source line is disconnected from ground, and wherein in the illumination off state, the common source line is connected to ground.

15. An image display method as recited in claim 11, wherein the common source line is disconnected from ground for a logic LOW illumination control signal for light emitting device activation, and the common source line is connected to ground for a logic HIGH illumination control signal for light emitting device deactivation.

16. An image display method comprising:

providing a dot matrix of a plurality of light emitting diodes (LEDs) to be arranged in a matrix with m-lines and n-columns such that a cathode of each of the LEDs disposed in each column is connected to a respective current line, and an anode of each of the LEDs disposed in each line is connected to a respective common source line;

controlling an activation state to be either active or inactive depending on an input illumination control signal and, in the active state, controlling conduction through one end of each common source line and each current line based on input display data; and floating the other end of each common source line in the active state, and grounding the other end of each common source line in the inactive state;

connecting, in the active state, the common source line selected by an input address signal to the current source; and storing n-sets of pixel level data of the sequentially input display data and, in the active state, putting the related current line in the conducting state for a pixel level width corresponding to the stored pixel level data.

17. An image display method as recited in claim 16, wherein said floating is achieved by providing a plurality of switches to be connected between each common source line and ground.

18. An image display method as recited in claim 17, wherein the illumination control signal controls a state of LED illumination to be on or off, wherein in the illumination on state, the switches are turned off to disconnect the common source line from ground, and wherein in the illumination off state, the switches are turned on to connect the common source line to ground.

19. An image display method as recited in claim 16, wherein the illumination control signal controls a state of LED illumination to be on or off, wherein in the illumination on state of the illumination control signal, the common source line is disconnected from ground, and wherein in the illumination off state, the common source line is connected to ground.

20. An image display method as recited in claim 16, wherein the common source line is disconnected from ground for a logic LOW illumination control signal for LED activation, and the common source line is connected to ground for a logic HIGH illumination control signal for LED deactivation.

* * * * *